US009549877B2

(12) United States Patent
Jenema et al.

(10) Patent No.: US 9,549,877 B2
(45) Date of Patent: Jan. 24, 2017

(54) ORAL DOSING DEVICE AND METHOD

(71) Applicant: TJJ Innovation LLC, Marquette, MI (US)

(72) Inventors: Tyler Jenema, Marquette, MI (US); Travis White, Zimmerman, MN (US)

(73) Assignee: TJJ Innovation LLC, Marquette, MI (US)

( * ) Notice: Subject to any disclaimer, the term of this patent is extended or adjusted under 35 U.S.C. 154(b) by 168 days.

(21) Appl. No.: 14/208,846

(22) Filed: Mar. 13, 2014

(65) Prior Publication Data

US 2015/0257979 A1 Sep. 17, 2015

(51) Int. Cl.

| | |
|---|---|
| ***A61J 7/00*** | (2006.01) |
| ***A61J 1/06*** | (2006.01) |
| *A61J 11/00* | (2006.01) |

(52) U.S. Cl.

CPC ..... *A61J 7/0053* (2013.01); *A61J 1/062* (2013.01); *A61J 11/001* (2013.01); *A61J 11/004* (2013.01); *A61J 2200/70* (2013.01); *A61J 2205/20* (2013.01); *A61J 2205/50* (2013.01)

(58) Field of Classification Search

CPC ..... A61J 7/0053; A61J 2200/76; A61J 1/062; A61J 11/004; A61J 2205/50; A61J 2200/70; A61J 2205/20; A61J 11/001

USPC ..... 604/77, 516, 131, 135

See application file for complete search history.

(56) References Cited

U.S. PATENT DOCUMENTS

| | | | | |
|---|---|---|---|---|
| 4,047,527 | A | 9/1977 | Kelsen | |
| 4,365,752 | A | 12/1982 | Waisbren et al. | |
| 8,062,254 | B2 | 11/2011 | MacLean | |
| 8,449,499 | B2 | 5/2013 | MacLean | |
| 2007/0186923 | A1* | 8/2007 | Poutiatine ..... | A61J 7/0038 128/200.14 |
| 2009/0177156 | A1 | 7/2009 | MacLean | |
| 2009/0254030 | A1 | 10/2009 | Sarraf | |
| 2011/0130740 | A1 | 6/2011 | Levy | |
| 2012/0101477 | A1 | 4/2012 | MacLean | |
| 2012/0103462 | A1 | 5/2012 | Levy | |
| 2012/0216909 | A1 | 8/2012 | Levy | |
| 2012/0241043 | A1 | 9/2012 | Perazzo | |
| 2014/0157731 | A1 | 6/2014 | Perazzo | |

* cited by examiner

*Primary Examiner* — Theodore Stigell
*Assistant Examiner* — Amber Stiles
(74) *Attorney, Agent, or Firm* — Fish & Richardson P.C.

(57) ABSTRACT

The subject matter of this specification describes, among other things, devices and processes for providing measured doses of oral medication to patients, such as infants or other vulnerable patients.

8 Claims, 10 Drawing Sheets

ORAL DOSING DEVICE AND METHOD

TECHNICAL FIELD

This specification relates to an oral dosing device and method that is suitable, in some embodiments, for delivering accurate micro-doses of a narcotic or other medicine to neonatal infants suffering from NNAS (Neonatal Narcotic Abstinence Syndrome).

BACKGROUND

NNAS is expressed as a number of symptoms that occur in a newborn infant who was exposed to addictive illegal or prescription drugs while in the mother's womb. Infants of mothers who consume alcohol during pregnancy may also be born with a similar condition. Causes of NNAS can occur when pregnant women take substances such as, amphetamines, barbiturates, benzodiazepines (e.g., diazepam, clonazepam), cocaine, marijuana, opiates/narcotics (e.g., heroin, methadone, codeine), and others. These and other substances pass through the placenta to the baby during pregnancy, and the baby can become addicted due to the mother's intake of these substances. At birth, the baby may still be dependent on the drug. Because the baby is no longer getting the drug after birth, symptoms of withdrawal may occur.

NNAS also occurs in some infants who are born prematurely, even to otherwise healthy mothers. Some premature infants are given ventilator support to assist their breathing, and are often sedated by intravenous morphine. Eventually, the infants are weaned off the ventilator but may still suffer symptoms of withdrawal and need treatment for NNAS.

Treatment for NNAS generally involves the administration of very small doses of a medication that eases withdrawal symptoms. The process of using an oral or other syringe to draw up medication from a stock bottle can be difficult and inaccurate to ensure appropriate dosing, especially when performed by the new parent or other at-home caregiver. Such difficulties and inaccuracies raise the risk for error and improper treatment for these vulnerable patients. The aforementioned process also presents a significant barrier to discharge for patients, since medical staff and/or social workers need to be confident that the parent or other at-home caregiver will be able to follow the prescribed regimen, and to not divert the supply of the narcotic from the infant for non-prescribed and possibly illegal purposes.

SUMMARY

In general, this document describes devices and processes for providing measured doses of oral medication to patients, such as infants or other vulnerable patients relying upon an at-home caregiver. For example, some embodiments of the oral dosing device can be used by an at-home caregiver so as to deliver accurate micro-doses of liquid medication (e.g., a narcotic in liquid form, such as methadone) to an infant suffering from NNAS. In particular implementations described herein, the oral device can be configured to reduce the likelihood of overdosing or underdosing the infant due to a relatively convenient user interface, an accurate yet relatively low-cost drive system that accurately and repeatably dispenses a user-selected dosage amount (e.g., in increments that are fractions of a milliliter in some embodiments), and an oral applicator tip sized and configured to safely insert into the infant's mouth (e.g., to rest against the infant's inner cheek surface). Optionally, the oral dosing device may also be equipped with one or more tamper-resistant structures that reduce the likelihood of the caregiver (or another person handling the oral dosing device) from externally accessing the medicine reservoir housed within the oral dosing device.

In particular embodiments, an oral dosing device may include a housing having a proximal end, a distal end, and an interior space defined between the first end and the second end. Also, the oral dosing device may include a medicine cartridge disposed within the housing and having a movable plunger at least partially disposed within the medicine cartridge. The oral dosing device may further include a flexibly compliant oral applicator tip positioned at the distal end and shaped to slidably engage an inner surface of a mouth. A fluid conduit defined in the distal end may extend from the medicine cartridge to a distal port of the flexibly compliant oral applicator tip. The oral dosing device may also include a dosage selector device positioned along the housing. The dosage selector device may be configured to receive manual user selection and may be configured to display a value indicative of a selected dosage amount. The oral dosing device may further include a dose activator positioned along the housing and being different from the dosage selector device. Optionally, in response to user actuation of the dose activator relative to the housing, the moveable plunger can be displaced by a distance based at least in part on the selected dosage amount displayed by the dosage selector.

Some embodiments described herein include a method of controlling an oral dosing device. The method may include receiving user input at a dosage selector of a handheld oral dosing device. The user input may be indicative of a selected dosage amount to be dispensed from a medicine cartridge mounted in a housing of the handheld oral dosing device. The selected dosage amount can be displayed by the oral dosing device in response to the user input. The method may also include, in response to user actuation of a dose activator positioned along the housing of the handheld oral dosing device, driving a moveable plunger forwardly within the medicine cartridge housed within the handheld oral dosing device by a longitudinal distance defined at least in part by the user input of indicative of the selected dosage amount. The method may further include causing the selected dosage amount of medicinal fluid to dispense from the medicine cartridge, through a fluid conduit extending from the medicine cartridge to a distal port of a flexibly compliant oral applicator tip of the handheld oral dosing device, and into a mouth adjacent to the flexibly compliant oral applicator tip.

Additional embodiments described herein include a method of using an oral dosing device. The method may include inserting a flexibly compliant oral applicator tip of a handheld oral dosing device into a mouth of an infant while grasping the handheld oral dosing device with a single hand. The method may also include manually adjusting with the single hand a dosage selector of the handheld oral dosing device to select a dosage amount of a narcotic fluid to be dispensed from a medicine cartridge mounted in a housing of the handheld oral dosing device. The selected dosage amount can be displayed by the oral dosing device. The method may optionally include actuating with the single hand a dose activator positioned along the housing of the handheld oral dosing device while flexibly compliant oral applicator tip of the handheld oral dosing device is positioned in the mouth of the infant. When the dose activator is actuated, the selected dosage amount of the narcotic fluid can be dispensed from the medicine cartridge, through a fluid conduit extending from the medicine cartridge to a distal port of the flexibly compliant oral applicator tip of the handheld oral dosing device, and into the mouth of the infant.

Some embodiments of the systems and techniques described here may provide one or more of the following advantages. First, some embodiments of the oral dosing device and the methods described herein can provide accurate dosing of small quantities of liquid medicinal fluid or other fluids to infants. For example, in the context of treating an infant suffering from NNAS, the oral dosing device can be readily handled and used by a relatively inexperienced at-home caregiver so as to accurately and repeatably dispense micro-doses of a medicinal liquid comprising methadone (e.g., user-selectable increments of 0.5 milliliters or less, 0.01 to 0.5 milliliters, 0.1 milliliters or less, or 0.01 milliliters or less in various embodiments).

Second, some embodiments of the oral dosing device and the methods described herein can be implemented in a configuration to resist tampering and external access to the medicine or other fluids by unauthorized persons. For example, in some circumstances where the at-home caregiver is a former or current addict, the liquid medicine reservoir can be sealed within the housing of the oral dosing, may be fully or partially surrounded with a dye substance or reactive substance that will mix with the liquid medicine if subjected to tampering, or may be equipped with other tamper-resistant structures that reduce the likelihood of the caregiver (or another person handling the oral dosing device) from externally accessing the medicine reservoir housed within the oral dosing device.

Third, some embodiments of the oral dosing device and the methods described herein can be implemented so that the caregiver can conveniently, with a single hand, select the dosage amount, insert the applicator tip into an infant's mouth, and then activate the dispensation of the liquid medication—all while holding the infant in the caregiver's other arm. As such, the infant can be readily soothed during the dispensation of the micro-doses of the liquid medicine over a period of days or weeks.

The details of one or more implementations are set forth in the accompanying drawings and the description below. Other features and advantages will be apparent from the description and drawings, and from the claims.

DETAILED DESCRIPTION OF ILLUSTRATIVE EMBODIMENTS

In general, this document describes devices and processes for providing measured doses of oral medication to infants. Some embodiments of the dosing devices are substantially self-contained, single-use devices in which the prescribed medication and an activation mechanism are located within closed housing of the device. In those embodiments, the oral dosing device is discarded after the medicine supply therein is exhausted or expired (e.g., the reservoir in the device is not refillable by the end-user such as an at-home caregiver). The dosing devices may be configured to be operated with a single hand (e.g., while holding an infant or other vulnerable patient with the user's other arm) to dispense predetermined amounts of the medication though a compliant oral applicator tip, and include user controls for incrementally selecting dosage amounts, viewing selected dosage amounts, and initiating dispensation of the selected dosage. Also, in general, the dosing devices can include over-dosage and/or tamper-resistance safeguards that can reduce the likelihood of diverting the medicine supply to an unauthorized user, thereby aiding a caregiver (e.g., a mother or other at-home caregiver) who formerly or currently suffers from abusing or misusing additive substances.

Figure 1:
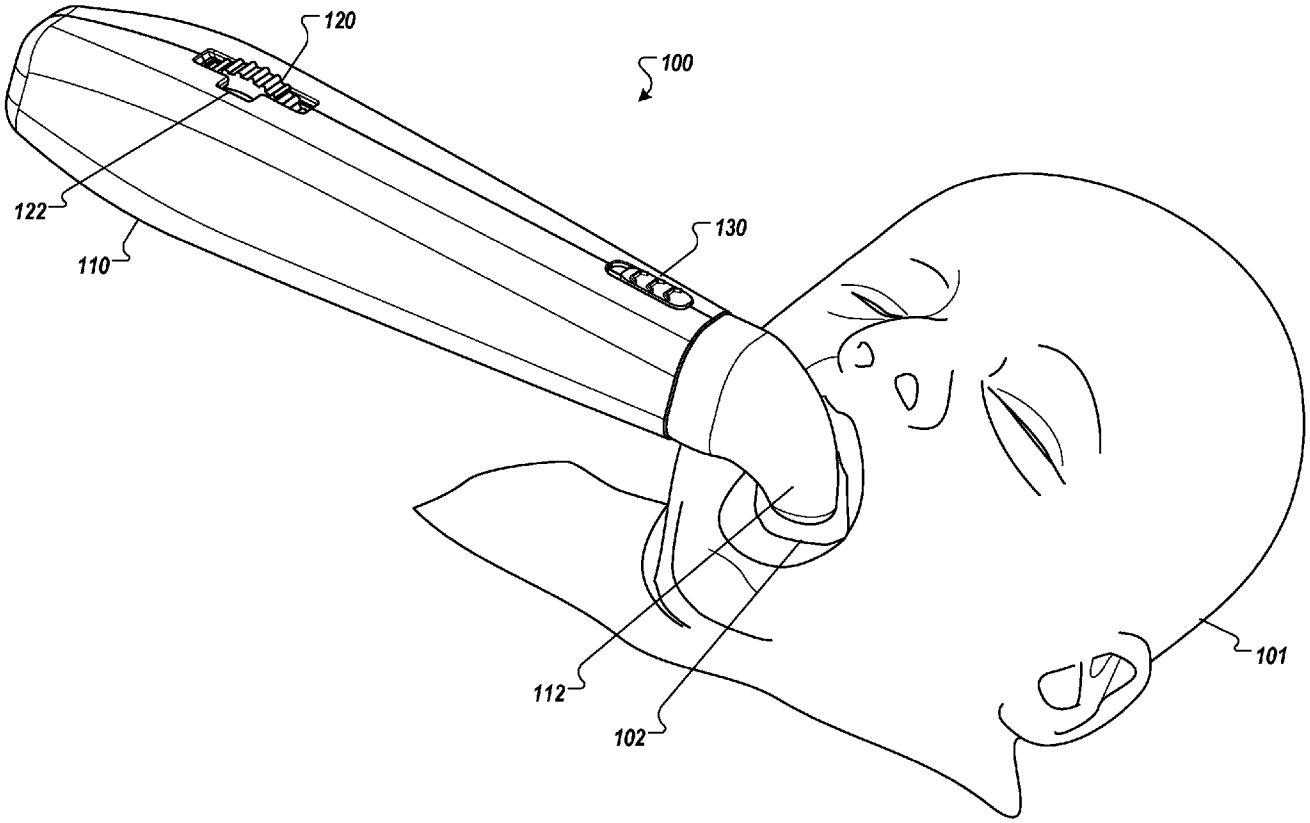
FIG. 1 is a perspective view of an oral dosing device, in accordance with some embodiments.

Referring to FIG. 1, some embodiments of an oral dosing device 100 include a housing 110 generally configured as a graspable shape that is ergonomic to an adult hand. A distal end of the housing 110 includes an oral applicator tip 112. The oral applicator tip 112 is formed of a compliant material (e.g., rubber, latex, plastic, or another medical-grade flexible material suitable for engaging an inner cheek surface) sized for at least partial insertion into the mouth 102 of an infant 101, and includes a fluid conduit (not visible in this view) through which medicine can flow. The oral applicator tip 112 can have a curved shape that facilitates insertion into an infant's mouth while also directing the user-control components (described below) away from the infant's face. Additionally, the curved shape of the oral application tip 112 in combination with the compliant outer surface material can be used to safely rest the tip against the infant's cheek when the dose activator 130 (described in more detail below) is triggered by the caregiver.

The housing 110 also provides a dosage selector 120 and a dosage indicator 122 for access by the caregiver. In this embodiment, the dosage selector 120 is manually operable by a user to select a dosage amount, which is displayed by the dosage indicator 122. The dosage selector 120, for example, can be rotated to a particular position to implement a user-selectable dosage in increments of 0.5 ml or less, 0.01 to 0.5 ml, 0.1 ml or less, or 0.01 ml or less in various embodiments. In this embodiment depicted in FIG. 2, the selected dosage may be selected in units of about 0.01 ml. A dose activator 130, which is different from and spaced apart from the dosage selector 120, is manually actuatable by the user to trigger dispensation of the selected dose.

Figure 2:
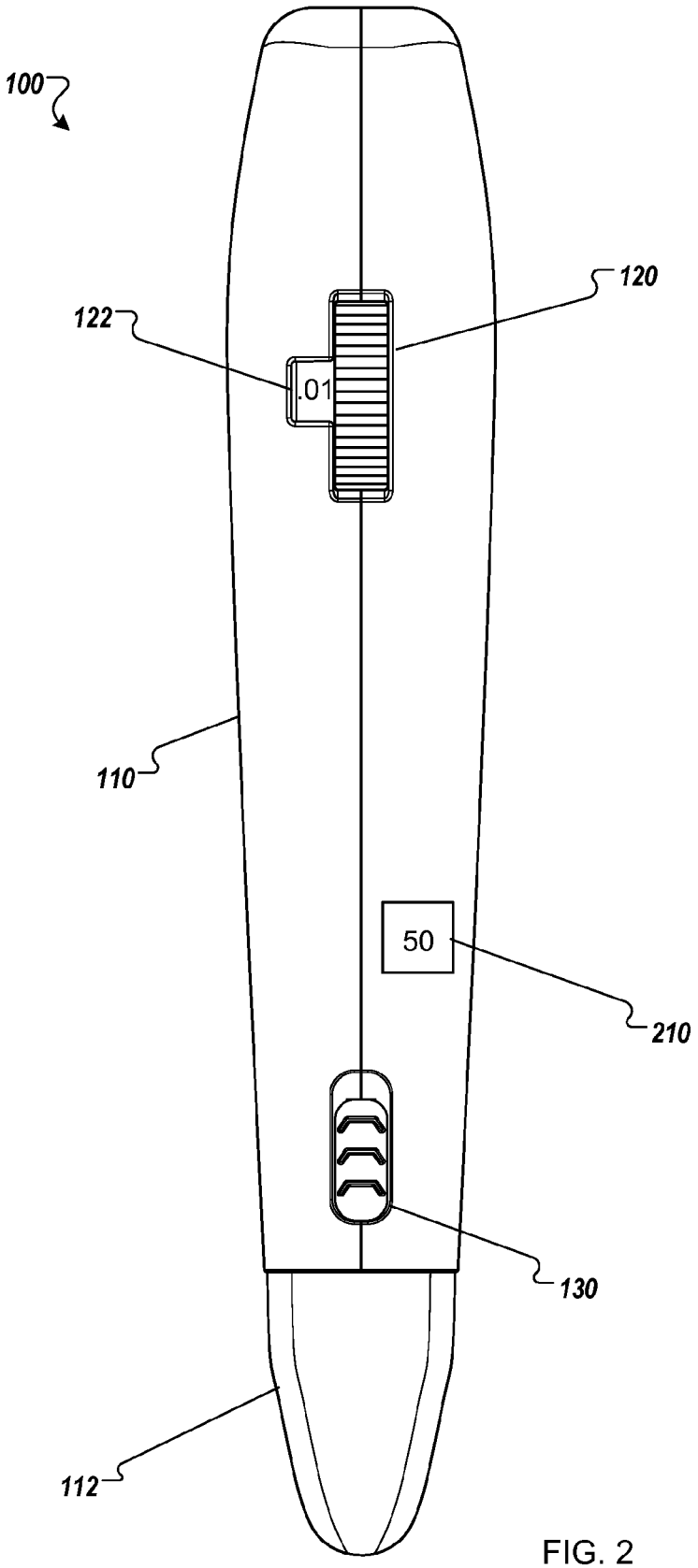
FIG. 2 is a top view of the oral dosing device of FIG. 1.

Referring to FIG. 2, the oral dosing device 100 can limit the number of external components exposed to the caregiver, such as the housing 110, the tip oral applicator 112, the dosage selector 120, the dose activator input 130, and the dosage indicator 122 (e.g., while the medicine reservoir housed within the device 100 is partially or fully concealed from the caregiver). The dosage indicator 122 displays a value indicative of a selected dosage amount. In some embodiments, the dosage indicator 122 can display units of fluid volume (e.g., milliliters, fluid ounces), weight (e.g., grams, ounces), molar mass, amount of substance, or any other appropriate unit. In some embodiments, the dosage selector 120 and/or the dosage indicator 122 are configured to accept and display selectable quantities of about 0.01 milliliters or less.

The housing 110 may optionally present a status indicator 210 for viewing by the caregiver. In some embodiments, the status indicator 210 displays a value indicative of a cumulative dosage amount dispensed from the device 100 or a medicine cartridge (not shown in this view) included in the device 100. For example, the status indicator 210 can display a number of fluid units (e.g., ml) that have been dispensed from the device 100 since a selected time in the past. In some embodiments, the status indicator 210 can display a value indicative of a cumulative dosage amount remaining in the device 100 or the medicine cartridge. For example, the status indicator 210 can display a number of fluid units (e.g., ml) that remain available to be dispensed from the device 100. In another example, the status indicator 210 can be an analog gauge (e.g., a thermometer-type display) showing a non-numerical representation of the relative amount of medicine that has been dispensed from or remains to be dispensed from the device 100. In some embodiments, the status indicator 210 can display an indication of a status of the device 100 or the medicine cartridge. For example, the status indicator 210 can display a first color (e.g., green) or symbol (e.g., smiling face, thumbs up) under normal operating conditions of the device 100, and can display a second color (e.g., yellow, red) or symbol (e.g., frowning face, thumbs down, exclamation point) under abnormal operating conditions of the device 100 (e.g., a malfunction, low number of remaining doses, need for new device 100/medicine supply).

Figure 3:
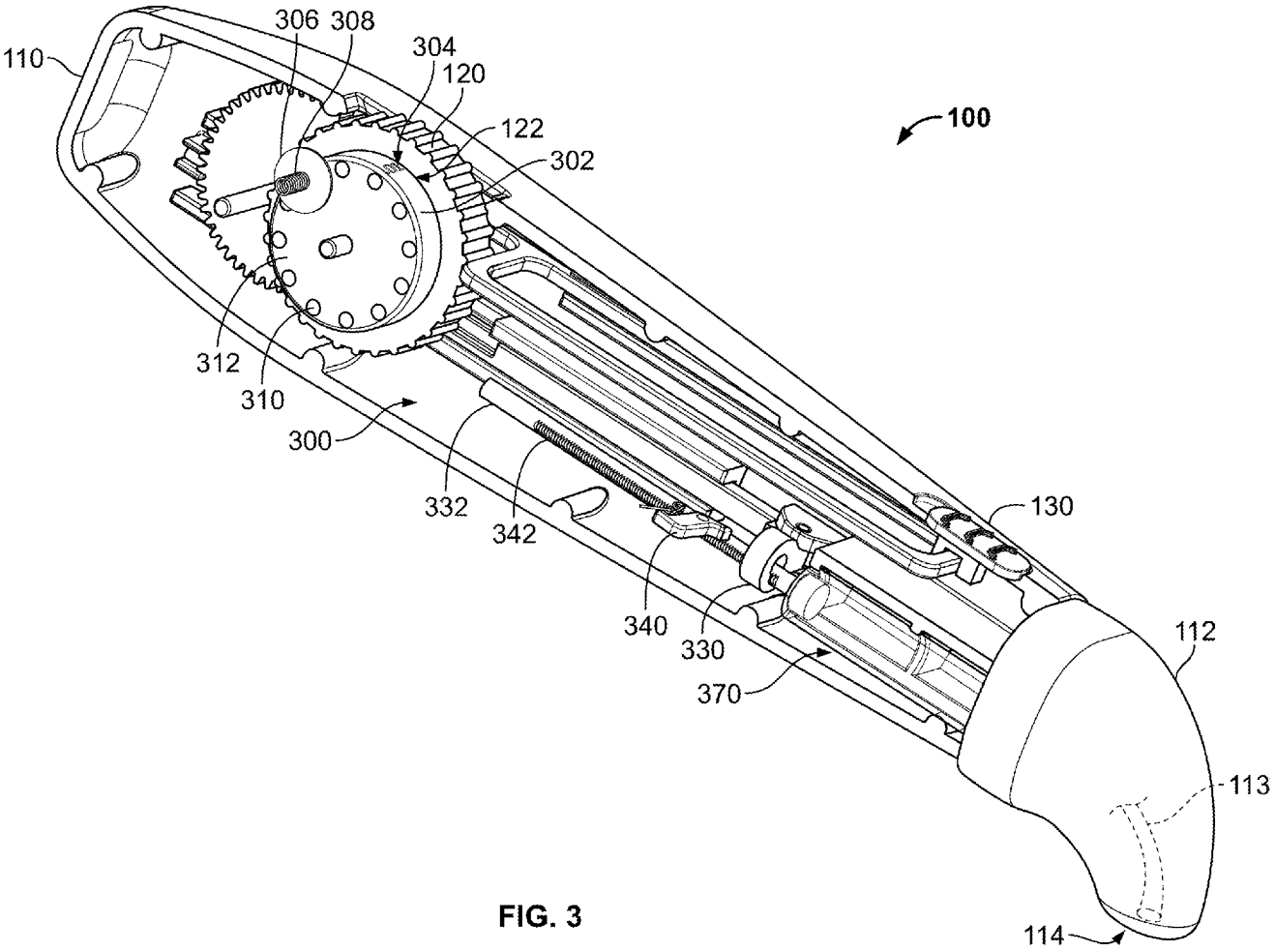
FIG. 3 is a side perspective view of the oral dosing device of FIG. 1, with a portion removed from view for purposes of illustrating a drive system in accordance with some embodiments.

Referring now to FIGS. 3, 4, 5, 6A, and 6B the oral dosing device 100 can include a drive system 300 within the housing 110 that is configured to accurately dispense micro-doses of a liquid medication in response to actuation of the dose activator 130. As shown in FIG. 3, in the illustrated example the dosage selector 120 is configured in this embodiment as a thumb wheel that is rotatable to select a target dosage. The dosage indicator 122 is configured as a disk having a peripheral outer edge 302. A collection of indicia 304 (e.g., numbers) indicative of dosage amounts are included about the circumference of the outer edge 302 and are aligned with and correspond to various rotational positions of the dosage selector 120. The dosage indicator 122 is coupled to and rotates with the dosage selector 120 to display the dosage amount that is selected based on the selected rotational position of the dosage selector 120.

Figure 4:
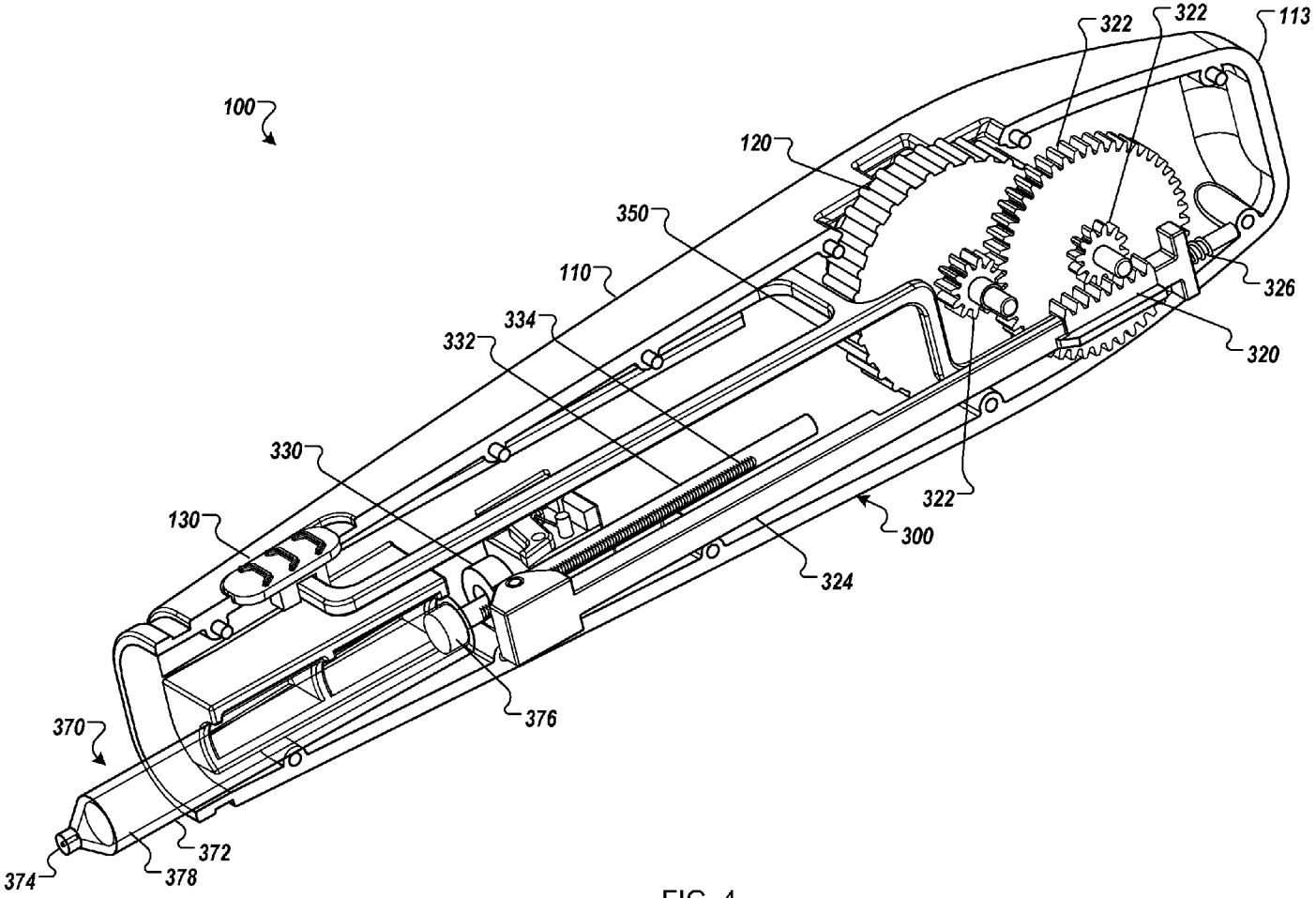
FIG. 4 is another side perspective view of the oral dosing device of FIG. 1, with another portion removed from view for purposes of illustrating the drive system of FIG. 3.
Figure 5:
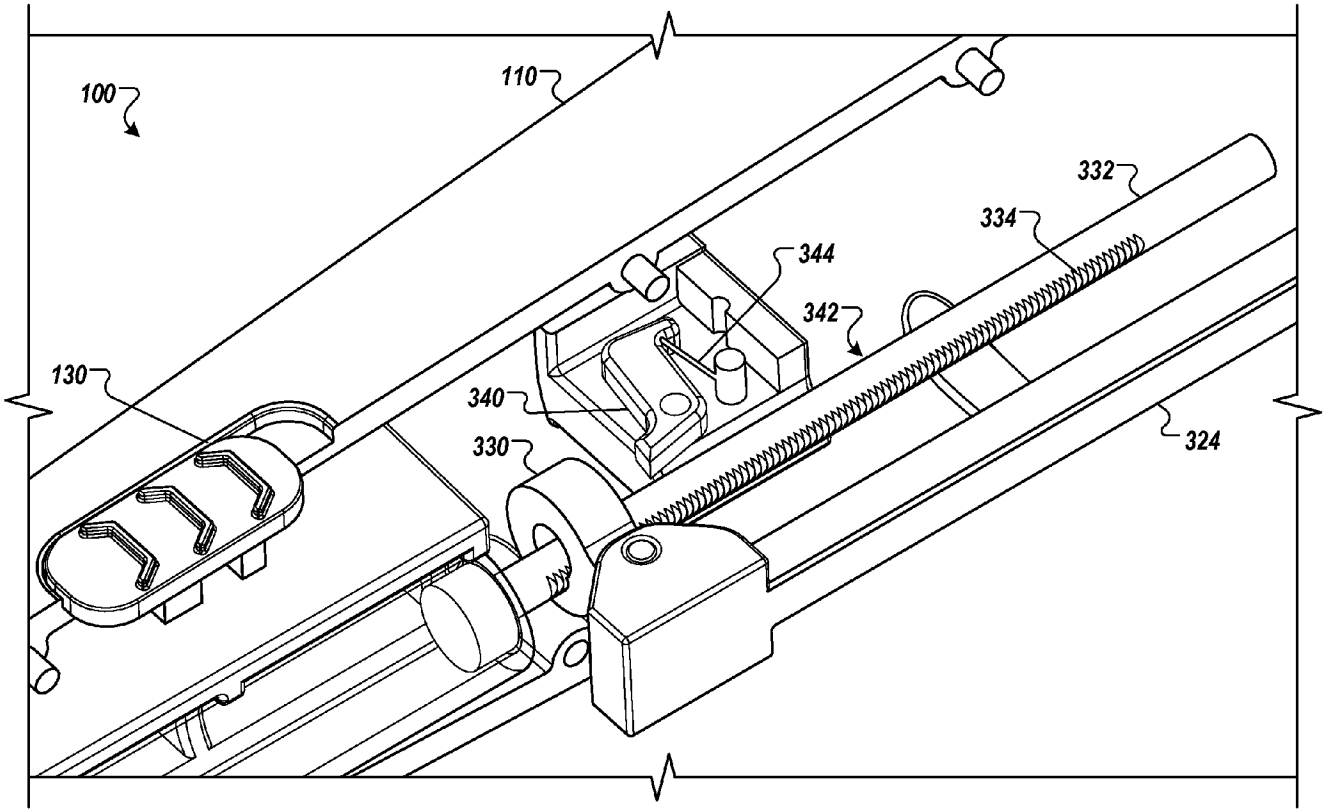
FIG. 5 is a perspective view of another portion of the drive system of FIG. 3.

Referring now to FIGS. 4-5, the dosage selector 120 is linked to a gear rack 320, optionally, by a collection of gears 322. The collection of gears 322 provides a reduction in gear ratio between the rotation of the dosage selector 120 and linear motion of the gear rack 320. In some implementations, the collection of gears 322 can provide a gear reduction of about 4:1. Rotation of the dosage selector 120 urges linear movement of a linkage (e.g., a linear translation rod 324 in this embodiment) connected to the gear rack 320 rearward, toward a proximal end 113. The rearward movement of the linkage 324 compresses a bias spring member 326. In the depicted embodiment, the rearward movement of the linkage 324 also draws a lasso ratchet 330 along a plunger 332. The lasso ratchet 330 engages a collection of ratchet teeth 334 formed along the length of one side of the plunger 332. During the rearward translation of the lasso ratchet 330 and the linkage 324 (FIG. 4), the plunger 332 is retained in a generally stationary position due to a stop pawl 340 (FIG. 3) that engages a collection of ratchet teeth 342 formed along the length of another side of the plunger 332. A torsion spring 344 (FIG. 5) urges the stop pawl 340 to engage the ratchet teeth 342 to thereby retain the forward position of the plunger 332 and to resist rearward movement of the plunger 332 as the lasso ratchet 330 is drawn rearward in response to operation of the dosage selector 120.

Referring to FIG. 3, the dosage indicator 122 in this embodiment includes a detent assembly 306. The detent assembly 306 is configured to resist rotation of the dosage selector 120 beyond a number of predefined biased positions. For example, the detent assembly 306 includes a spring 308 configured to bias a convex bearing (not visible in FIG. 3) that locates in any one of a collection of incremental depressions 310 formed in a lateral surface 312 of the dosage indicator 122. In this embodiment, both the detent assembly 306 and the spring 308 are mounted to a portion of the housing 110 (the portion that is not shown in FIG. 3) so as to remain in the depicted position while the incremental depressions 310 are moved by the user to different rotational positions. As a dosage is being selected, the detent assembly 306 engages the depressions 310 to assist a user with the selection of substantially even dosage increments. For example, the detent assembly can provide an audible and/or tactile "click" for each selectable dosage increment (e.g., 0.01 ml, 0.02 ml, 0.03 ml, etc. in this embodiment). Accordingly, from the teachings herein, it should be understood that the detent assembly 306 and incremental depressions can be selected according to a variety of different options (e.g., to provide more incremental positions or less incremental positions) based upon the micro-dose increments for a particular embodiment and based upon the maximum dosage-per-dispensation amount.

The detent assembly 306 is also configured to resist rotation of the dosage selector 120 under bias force provided by the spring 326 (e.g., during selection of a dosage). With the spring 326 compressed and the lasso ratchet 330 and the linkage 324 drawn rearward, and with the detent assembly 306 resisting forward motion of the linkage 324, the oral dosing device 100 is configured to deliver the selected dosage (e.g., the device is "cocked").

Referring again to FIG. 4, in this embodiment, the dose activator 130 is configured to actuate an activator arm 350 (and thereby triggers movement of the plunger 332 under the bias force from the spring 326). The activator arm 350 in the depicted embodiment extends from the dose activator input 130 to a position proximal to the gear rack 320. As described in more detail below, when the user actuates the dose activator 130 so as to move the activator arm 350 relative to the gear rack 320, the stored energy in the spring member 326 is released to drive the linkage 324, lasso ratchet 330, and plunger 332 in a forward direction toward to the medicine cartridge 370.

Figure 6A:
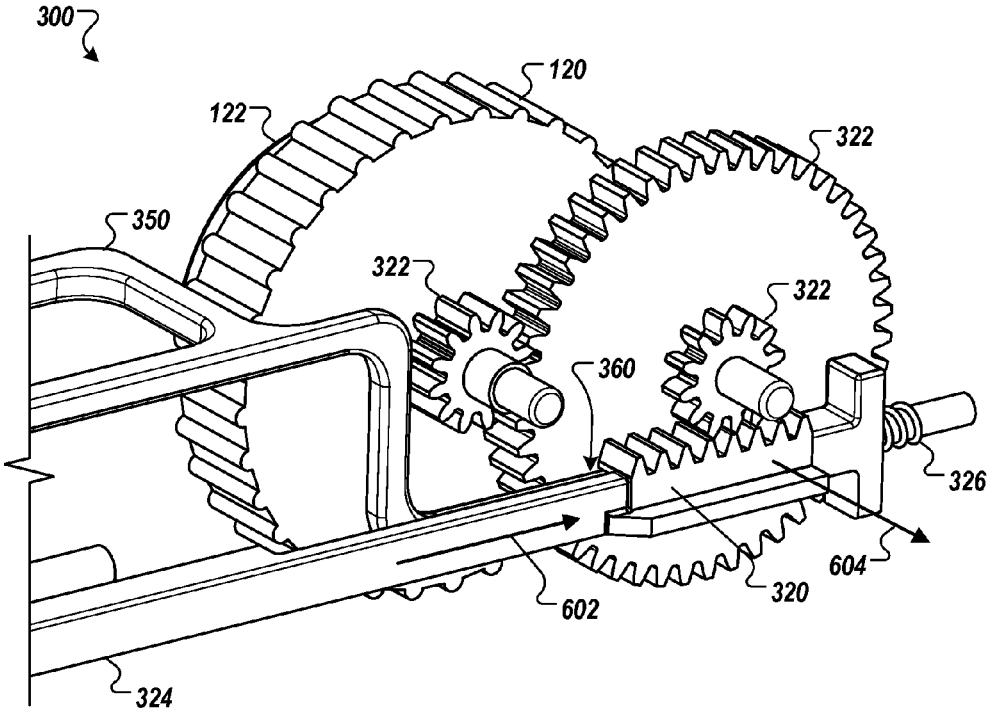
FIGS. 6A-6B are perspective views of a portion of the drive system of FIG. 3.
Figure 6B:
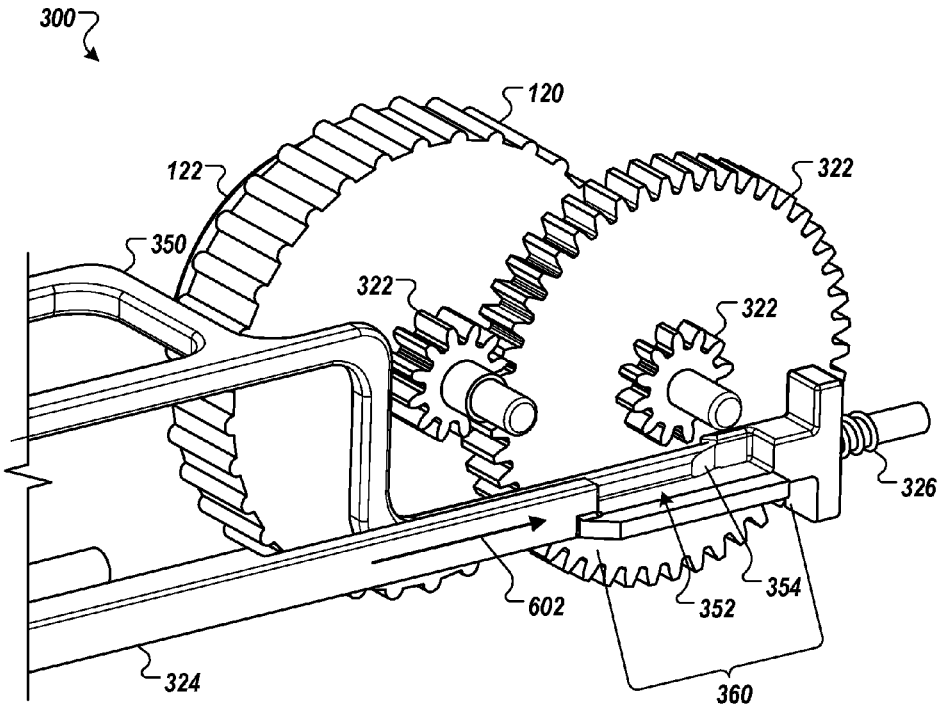

Referring now to FIG. 6AB, the gear rack 320 can be adjusted to from a first position to a second (disengaged) position in response to the activator arm 350 forcing the gear rack 320 in a lateral sliding path 604 (FIG. 6A). In FIG. 6A, a magnified view of the gear rack 320, the linkage 324, and the gears 322 is shown, and in FIG. 6B, the gear rack 320 removed from view to reveal a portion 352 of the activator arm 350. For example, when the activator arm 350 is manually moved (in response to the user actuation of the dose activator 130), the portion 352 extends into a space 360 where the linkage 324 is aligned substantially parallel to the gear rack 320. The portion 352 includes a wedge 354 that is configured to slidingly contact the gear rack 320 or a portion thereof. In operation, the dose activator input 130 is moved rearward, which likewise causes a rearward movement of the activator arm 350 as indicated by the arrow 602, urging the wedge 354 rearward as well.

As the wedge 354 moves rearward as indicated by the arrow 602, the wedge 354 (not visible in FIG. 6A; refer to FIG. 6B) urges the gear rack 320 to slide laterally outward as indicated by the arrow 604. As the gear rack 320 is moved outward, the gear rack 320 becomes disengaged from the detent assembly 306 though the collection of gears 322. In response to this disengagement, the linkage 324 is urged forward by the spring 326 (which stored potential energy as a result of the user's earlier selection of a dosage amount. The gear rack 320 can be biased to return to the engaged position (FIG. 6A) by another spring (not shown in FIGS. 6A-B) positioned on the lateral side of the gear rack opposite from the detent assembly 306. As such, during or after the linkage 324 is moved forward toward the medicine cartridge 370 to cause dispensation of a micro-dose of the medicine, the gear rack 320 slidingly returns to the engaged position (e.g., engages with the gear 322 in this embodiment) so that the device 100 is prepared for the next occurrence of the user's selection of a new dosage amount.

Referring again to FIG. 4, the plunger 332 engages a medicine cartridge 370. The medicine cartridge 370 is formed as a syringe having a barrel 372, a tip 374, and a moveable plunger head 376. A cavity 378 within the barrel 372 is configured to hold one or more doses of flowable content such as a medicine. In some embodiments, the medicine cartridge 370 may be configured to hold about 5-10 mg of fluid.

As the linkage 324 is urged forward, the lasso ratchet 330 engages the plunger 332 to urge the moveable plunger head 376 into the cavity 378 a predetermined distance based on the selected dosage. In response, the selected dosage of the content of the cavity 378 is urged to flow out the tip 374. Referring now to FIG. 3, the tip 374 (not visible in this view) is fluidly connected to a fluid conduit 113 defined within the oral applicator tip 112 and extending from the medicine cartridge 370 to a distal port 114 of the oral applicator tip 112.

In some embodiments, the housing 110 and the oral applicator tip 112 may be configured to resist access to the medicine cartridge 370. For example, infants who suffer from NNAS due to their mothers' use of heroin during pregnancy may be prescribed small dosages of methadone (or another liquid medication suitable for treating NNAS) as a treatment for withdrawal using the device 100. The methadone, however, may present a great temptation for a mother or other individuals, for example, due to that individual's own addiction problems or due to the illegal street value of the methadone. For example, the housing 110 may be sonically welded together to resist tampering and to prevent access to the medicine cartridge 370 housed herein (e.g., the device 100 would be destroyed during any attempt to access the medicine cartridge 370 by an unauthorized user). In another example, the medicine cartridge 370 may be partly surrounded by a dye solution that can stain the skin and/or clothing of a person who has tampered with the device 100 or partly surrounded by another liquid agent that reacts with or reduces the effectiveness/desirability of the medicinal liquid in the cartridge 370.

In some optional embodiments, the housing 110 and the oral applicator tip 112 may be configured to permit access to the medicine cartridge 370. For example, the medicine cartridge 370 may be accessed by trained practitioners to be refilled or replaced so that the device 100 may be recycled for use with a new supply of medicine. In some embodiments, the housing 110 and the oral applicator tip 112 may be configured to resist unauthorized access to the medicine cartridge 370. For example, the housing 110 may include features (e.g., keying) that can allow doctors, nurses, pharmacists, or other trained practitioners to access and replace the medicine cartridge 370, while resisting unauthorized access by others.

In some embodiments, the status indicator 210 can be embodied as a transparent window along the housing 110 that provides a view of the medicine cartridge 370 retained therein. For example, the user can look through the window to see how much fluid remains in the medicine cartridge 370. Such a viewing window can be used as a status indicator, in one example, when the window is positioned adjacent to at least a portion of the distal half of the medicine cartridge, thereby permitting the user to view the movable plunger head 376 as it is moved closer to the distal end of the cartridge 370 (thereby indicating the cartridge 370 is nearing exhaustion).

Figure 7:
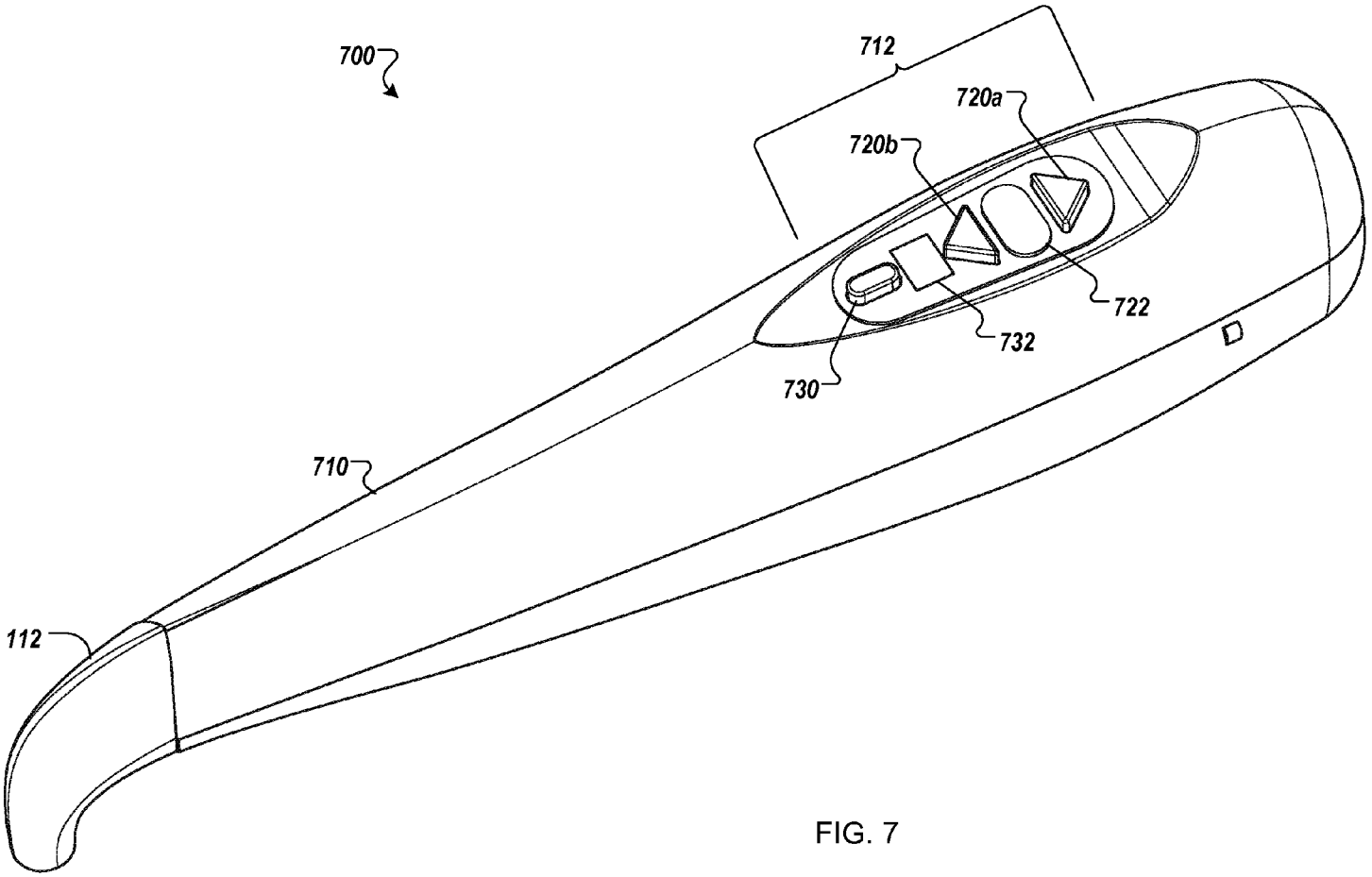
FIG. 7 is a perspective view of another oral dosing device, in accordance with additional embodiments.

Referring to FIG. 7, another oral dosing device 700 in accordance with other embodiments can include a different user interface, a different internal drive system, or both. The device 700 in this embodiment includes a housing 710 generally configured as a shape that is ergonomic to an adult hand. Similar to the previously described embodiments, a distal end of the housing 710 includes the oral applicator tip 112.

The housing 710 also presents a collection of user interface controls 712. The controls 712 include a first dosage selector 720*a*, a second dosage selector 720*b*, and a dosage indicator 722. The first and second dosage selectors 720*a* and 720*b* are manually operable by a user to select a dosage amount (e.g., incrementally increasing or decreasing), which is displayed on a screen of the dosage indicator 722. For example, the dosage selector 720*a* can be a button that can be actuated to increase a selected dosage by a predetermined amount, and the dosage selector 720*b* can be a button that can be actuated to decrease the selected dosage by a predetermined amount. In some embodiments, the selected dosage may be selected in units of about 0.01 ml or less. In some embodiments, the selected dosage may be selected in units of about 0.001 ml or less. The selected dosage amount is displayed by the dosage indicator 722, which in some embodiments can be a liquid crystal display or other type of display. A dose activator input 730 is manually operable by the user to initiate dispensation of the selected dose.

The housing 710 may optionally provide a status indicator 732. In some embodiments, the status indicator 732 can display a value indicative of a cumulative dosage amount dispensed from the device 700 or a medicine cartridge (not shown in this view; refer to the medicine cartridge 370 of FIGS. 3, 4, and 8) housed in the device 700. For example, the status indicator 732 can display a number of fluid units (e.g., ml) that have been dispensed from the device 700 since a selected time in the past. In some embodiments, the status indicator 732 can display a value indicative of a cumulative dosage amount remaining in the device 700 or the medicine cartridge. For example, the status indicator 732 can display a number of fluid units (e.g., ml) that remain available to be dispensed from the device 700. In another example, the status indicator 732 can emulate an analog gauge (e.g., a thermometer-type display) showing a non-numerical representation of the relative amount of medicine that has been dispensed from or remains to be dispensed from the device 700. In some embodiments, the status indicator 732 can display an indication of a status of the device 700 or the medicine cartridge. For example, the status indicator 732 can display a first color (e.g., green) or symbol (e.g., smiling face, thumbs up) under normal operating conditions of the device 700, and can display a second color (e.g., yellow, red) or symbol (e.g., frowning face, thumbs down, exclamation point) under abnormal operating conditions of the device 700 (e.g., a malfunction, low number of remaining doses, need for a refill, expiration of the medicine, spoilage of the medicine).

Figure 8:
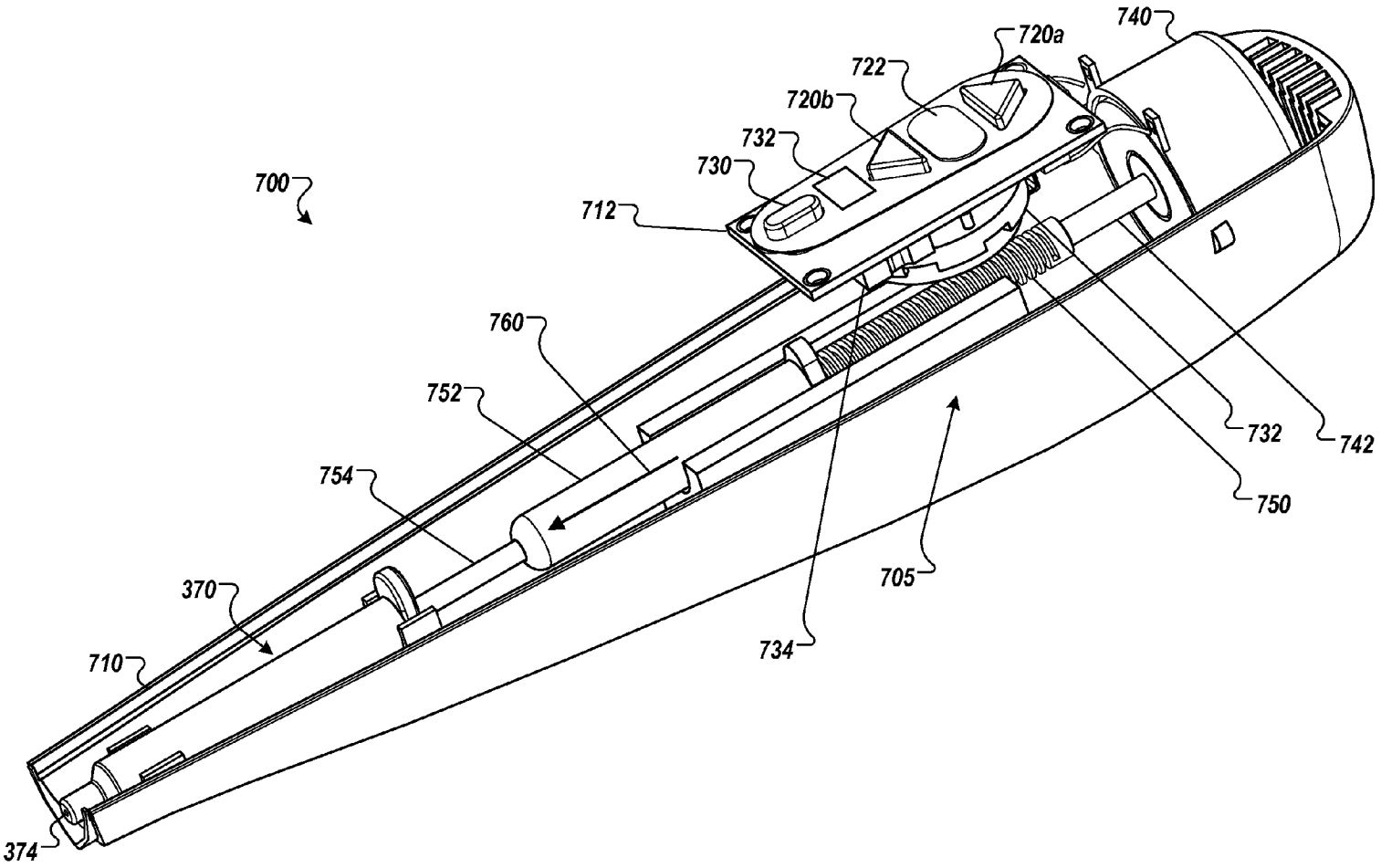
FIG. 8 is a side perspective view of the oral dosing device of FIG. 7, with a portion removed from view for purposes of illustrating a drive system in accordance with some embodiments.

FIG. 8 is a side perspective view of the oral dosing device 700 of FIG. 7, with a portion of the housing 710 removed from view for purposes of illustrating a drive system 705 in accordance with some embodiments. The collection of user controls 712 also includes a circuit assembly 734 and a battery 732. The battery 732 provides power for the circuit assembly 734. The circuit assembly 734 includes circuitry (e.g., passive and active electronic components, processors, and the like, all of which can be assembled to at least one circuit board housed in the device 700) configured to receive input from the dosage selectors 720*a* and 720*b* and the dose activator input 730, and to drive output through the dosage indicator 722 and the status indicator 732.

The circuit assembly 734 is also electrically connected to a motor 740 and configured to selectively activate the motor 740. In some embodiments, the motor 740 can be a stepper motor, a servo motor, or the like. The motor 740 includes an output shaft 742 that is rotationally coupled to a lead screw 750. The lead screw 750 is a threaded shaft that is formed to threadedly engage a collection of correspondingly configured threads (not shown) formed in an interior cavity a barrel 752. Rotation of the lead screw urges the barrel 752 forward as indicated by the arrow 760. The barrel 752 is coupled to a plunger 754, which engages the moveable plunger head 376 (not visible in this view) of the medicine cartridge 370.

In use, a user selects a dosage amount using the dosage selectors 720*a* and 720*b* and activates the dose activator input 730 to initiate dispensing of the selected dose of medicine. The circuit assembly 734 responds to activation of the activator input 730 by controllably providing power from the battery 732 to the motor 740 so as to rotate the shaft 742 by a selected amount defined according to the user's selected dosage amount. The motor 740 is configured to rotate the shaft 742 and the lead screw 750 by a predetermined amount (e.g., degrees, steps) to urge the barrel 752, the plunger 754, and the movable plunger head 376 by a predetermined linear distance to urge the selected dosage of the content of the medicine cartridge 370 to flow out the tip 374. The tip 374 is fluidly connected to a fluid conduit defined within the oral applicator tip 112 (not visible in this view) and extending from the medicine cartridge 370 to the distal port 114 of the oral applicator tip 112.

Similar to previously described embodiments, the housing 710 can optionally include transparent window that provides a view of the medicine cartridge 370. For example, the user can look through the window to see how much fluid remains in the medicine cartridge 370. Such a viewing window can be used as a status indicator, in one example, when the window is positioned adjacent to at least a portion of the distal half of the medicine cartridge, thereby permitting the user to view the movable plunger head 376 as it is moved closer to the distal end of the cartridge 370 (thereby indicating the cartridge 370 is nearing exhaustion).

In some embodiments, the housing 710 and the oral applicator tip 112 may be configured to resist access to the medicine cartridge 370. For example, the housing 710 may be sonically welded together to resist tampering and to prevent access to the medicine cartridge 370 housed herein (e.g., the device 700 would be destroyed during any attempt to access the medicine cartridge 370 by an unauthorized user). In another example, the medicine cartridge 370 may be partly surrounded by a dye solution that can stain the skin and/or clothing of a person who has tampered with the device 700 or partly surrounded by another liquid agent that reacts with or reduces the effectiveness/desirability of the medicinal liquid in the cartridge 370. In another example, the circuit assembly 734 can include alarms or notification when an unauthorized attempt to access the medicine cartridge is detected. For example, the circuit assembly 734 of the device 700 can be equipped with an audio alarm and control circuitry to activate the audio alarm when the housing 710 is opened/accessed or when the medicine cartridge is removed from the installed position within the housing 710. In another example, the circuit assembly 734 of the device 700 can be equipped with a wireless communication device (e.g., configured for Bluetooth communication, RF communication with a wireless network, or an emergency cellular communication) and control circuitry that emits a wireless alarm signal from the wireless communication device (e.g., for communication to a nearby companion device (e.g., a mobile computer device, a smartphone, etc.), to a cellular communication station, or to another communication system for purposes of alarming emergency services or law enforcement services.

In some optional embodiments, any of the devices 100 and 700 described herein can be equipped with a circuit assembly having a wireless communication device positioned within the housing 110 or 710. The wireless communication device can be used to selectively transmit data indicative of the usage of the device 100 or 700 (e.g., a summary of the dosage amounts, the corresponding dosage dispensation times (e.g., date, hour, minute), data indicative of the identification of the device (e.g., a serial number), data indicative of the identification the patient or caregiver (e.g., a name, phone number, and address), data indicative of the amount of medicine remaining in the cartridge, or other data pertinent to the treatment of the patient. For example, in response to the user actuating one or more user interface buttons positioned along the housing 110 or 710, the control circuitry housed within the device 100 or 700 can activate the wireless communication device to emit a wireless data signal for communication to a nearby companion device (e.g., a mobile computer device, a smartphone, or another device carried by a trained practitioner or otherwise capable of communicating to a remote device carried by a trained practitioner), to a cellular communication station, or to another communication system for purposes of communicating some or all of the previously described data to the trained practitioner.

Figure 9:
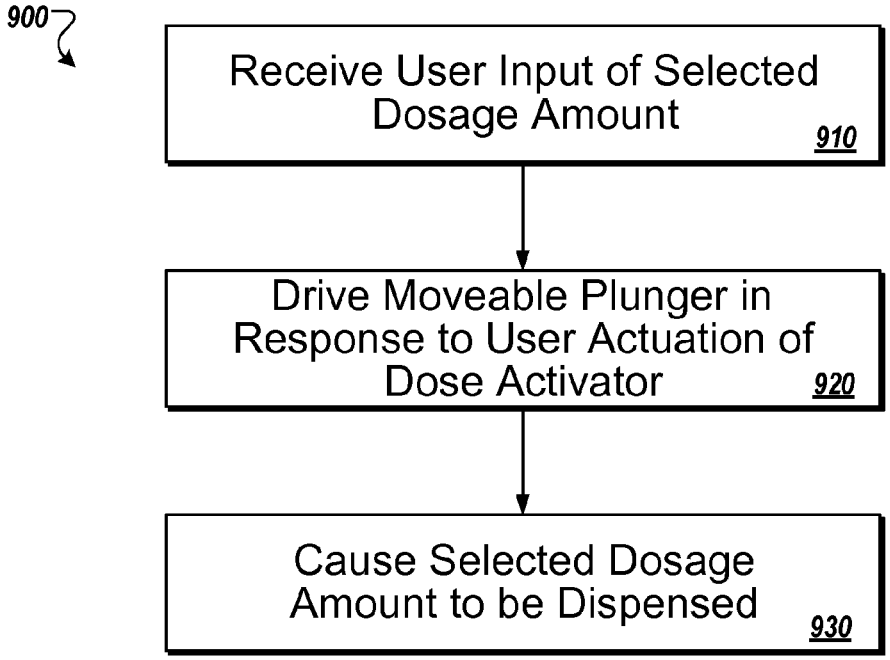
FIG. 9 is flow chart that shows an example of a process for controlling an oral dosing device, in accordance with some embodiments.

Referring to FIG. 9, some implementations of a process 900 can be performed for controlling an oral dosing device, such as the device 100 or the device 700 described previously herein. In some implementations, the process 900 can be used to deliver accurate micro-doses of liquid medication to an infant suffering from NNAS or another vulnerable patient. In particular, the process 900 may optionally be implemented in a manner that reduces the likelihood of overdosing or underdosing the infant while accurately and repeatably dispensing (over a period of days or weeks)

user-selected dosage amounts (e.g., in increments that are fractions of a milliliter in some embodiments).

At operation 910, user input is received at a dosage selector of a handheld oral dosing device, such as the device 100 or the device 700. In this implementation, the user input indicates a selected dosage amount that user intends to be dispensed from a medicine cartridge mounted in a housing of the handheld oral dosing device. For example, the user can interact with the dosage selector 120 (FIG. 1) or the dosage selectors 720*a*, 720*b* (FIG. 7). The selected dosage amount is displayed by the oral dosing device in response to the user input. For example, the selected dosage amount can be displayed by the dosage indicators 122 (FIG. 1) or 722 (FIG. 7). In some embodiments, the dosage can be selected in increments of 0.5 ml or less, 0.01 to 0.5 ml, 0.1 ml or less, or 0.01 ml or less, depending upon the dosage selector configuration, the drive system configuration, and other factors described herein. As previously described, the dosage selector 120 or the selectors 720*a*, 720*b* do not activate the device 100 or 70, respectively, to begin dispensation of the liquid medicine. Instead, the dose activator 130 (FIG. 1) or 730 (FIG. 7) is a separate user interface component that is subsequently actuated by the user to trigger the dispensation of the selected dosage of medicine when the user is ready (e.g., when the applicator tip is safely positioned within the patient's mouth).

At operation 920, in response to user actuation of a dose activator positioned along the housing of the handheld oral dosing device, the drive system is activated according to the user input in operation 910. For example, as previously described, the dose activator can act as a manual trigger that causes a moveable plunger to be driven forward within the medicine cartridge housed within the handheld oral dosing device by a longitudinal distance defined by the user input of indicative of the selected dosage amount. For example, the user can actuate the dose activator 130 or 730 to initiate movement of the plunger 332 or 754 by a predetermined linear distance that is proportional to the dosage amount selected by the user.

At operation 930, the selected dosage amount of medicinal fluid is dispensed from the medicine cartridge through a fluid conduit extending from the medicine cartridge to a distal port of a flexibly compliant oral applicator tip of the handheld oral dosing device, for example, into a mouth adjacent to the flexibly compliant oral applicator tip. For example, fluid urged out from the medicine cartridge 370 can flow through the tip 112 and into the mouth 102 of the infant 101.

In some embodiments in which the process 900 is performed using the device 100 (FIG. 1), the process 900 may optionally include can include one or more of the following operations: drawing a first pawl along a first ratchet connected to the movable plunger in response to actuation of the dosage selector; actuating a linkage connected to the first pawl so as to apply a bias force from a bias member to the movable plunger; engaging a second pawl with a second ratchet connected to the movable plunger so that a position of the moveable plunger is maintained against the bias force; and receiving input that moves the dose activator from a first position to a second position so that the movable plunger is urged forward by the bias force to cause dispensation of the medicinal fluid. For example, as previously described in connection with FIGS. 1-6B, the dose activator 130 can be actuated by a user from a first position to the a second position to trigger the drive system 300 to dispense the user defined micro-dose of the liquid medicine. The device 100 in such embodiments (FIGS. 1-6B) can include the linkage 324, the lasso ratchet 330, the pawl 340, the spring 326, and the ratchet teeth 334 and the ratchet teeth 342 along the plunger 332. The lasso ratchet 330 can be drawn along the ratchet teeth 334 in response to actuation of the dosage selector 120, compressing the spring 326. The pawl 340 engages the ratchet teeth 342. The detent 306 maintains position of the linkage 324 and the plunger 332 against the bias of the spring 326. A user can move the dose activator input 130 to a second position to release the linkage 324 and permit the spring 326 to urge the linkage 324 and the plunger 332 forward.

In some embodiments in which the process 900 is performed using the device 700 (FIG. 7), the process 900 may optionally include one or more of the following operations: receiving, at one or more dosage input buttons, input signals indicative of the selected dosage amount; receiving, at an activation button, input signals indicative of user input to begin dispensing the medical fluid; activating, by an electronic control circuit, a motor of a drive system to provide rotational output according to the selected dosage amount; and displacing, in response to the rotation output of the motor the motor, the moveable plunger by an axial translation distance based on the selected dosage amount. For example, as previously described in connection with FIGS. 7-8, the device 700 includes the dosage selectors 720*a* and 720*b* and the dose activator input 730. The device 700 also includes the motor 740 configured to drive the plunger 754. The circuit assembly 734 includes input circuits configured to receive input from the dosage selectors 720*a*, 720*b* and the dose activator input 730, and a circuit configured to drive the motor 740. The user can actuate the dosage selectors 720*a* and/or 720*b* to select a dosage amount, and actuate the dose activator input 730. In response to actuation of the dose activator input 730, the circuit assembly 734 can drive the motor 740 and cause the moveable plunger 754 to be moved a distance based on the dosage selected by the user.

In some embodiments, the process 900 can include displaying a value (e.g., on a status indicator) indicative of a cumulative dosage amount dispensed from the medicine cartridge 370. For example the dosage indicator 210 (FIG. 1) and 732 (FIG. 7) can display numbers, letters, and/or symbols that can show the user how many doses have been dispensed from the medicine cartridge 370.

In other embodiments, the process 900 can include displaying a value (e.g., on a status indicator) indicative of a cumulative dosage amount remaining the medicine cartridge 370. For example the dosage indicator 210 and 732 can display numbers, letters, and/or symbols that can show the user how many doses remain in the medicine cartridge 370.

Figure 10:
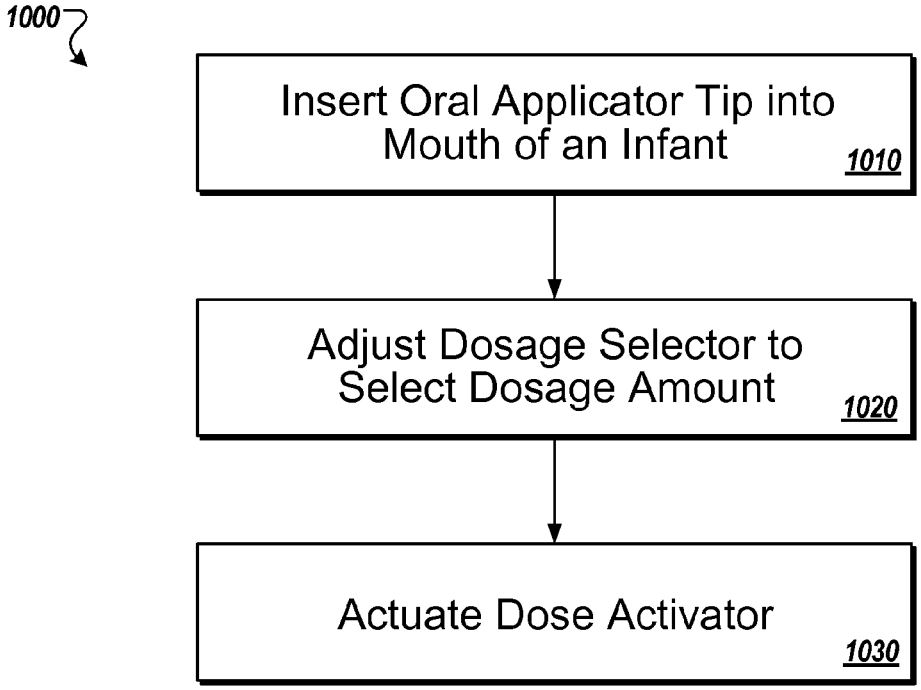
FIG. 10 is flow chart that shows an example of a process for using an oral dosing device, in accordance with some embodiments.

Referring now to FIG. 10, some implementations of a process 1000 for using an oral dosing device can facilitate accurate micro-doses of a medicine to a vulnerable patient, such as an infant. In some implementations, the process 1000 can be used with the oral dosing device 100 of FIG. 1, or the oral dosing device 700 of FIG. 7.

At operation 1010, a flexibly compliant oral applicator tip of a handheld oral dosing device is inserted into a mouth of an infant while grasping the handheld oral dosing device with a single hand. For example, the tip 112 of the device 100 or 700 can be formed of a flexible and compliant material, and be sized for partial insertion in the mouth 102 of the infant 101 so as to rest against the infant's inner cheek. The devices 100 and 700 both have housings 110, 710 that are sized and shaped for one-handed operation (while the infant is conveniently held or otherwise soothed with the other arm).

At operation 1020, a dosage selector of the handheld oral dosing device is manually adjusted with the single hand to select a dosage amount of a medicinal fluid (such as a narcotic fluid in this embodiment) to be dispensed from a liquid medicine cartridge mounted in a housing of the handheld oral dosing device. The selected dosage amount is displayed by the oral dosing device. For example, the user can actuate the dosage selector 120 or the dosage selectors 720*a*, 720*b*, and the selected dosage amount can be displayed by the dosage indicators 122 or 722. In some embodiments, the dosage can be a micro-dosage selected in increments of 0.5 ml or less, 0.01 to 0.5 ml, 0.1 ml or less, or 0.01 ml or less, depending upon the dosage selector configuration, the drive system configuration, and other factors described herein. It should be understood from the description herein that, in some optional implementations, operation 1020 can be performed before operation 1010.

At operation 1030, a dose activator positioned along the housing of the handheld oral dosing device is actuated with the single hand (e.g., the hand that contemporaneously grips the housing of the device) while the flexibly compliant oral applicator tip of the handheld oral dosing device is positioned in the mouth of the infant so that the selected dosage amount of the medicinal fluid (e.g., the narcotic fluid in this embodiment) is dispensed from the medicine cartridge. The narcotic fluid flows through a fluid conduit extending from the medicine cartridge to a distal port of the flexibly compliant oral applicator tip of the handheld oral dosing device, and into the mouth of the infant. For example, the devices 100 or 700 can be grasped by the user with a single hand. The tip 112 can be inserted into the mouth 102 of the infant 101, and the user can use the single hand to actuate the dosage selector 120 or selectors 720*a*/720*b* to select a dosage amount to be dispensed from the medicine cartridge 370, which may be filled with a narcotic fluid such as methadone. The selected dosage amount can be displayed by the dosage indicator 122 or 722. The user can use the single hand to actuate the dose activator input 130 or 730 to initiate dispensing of the fluid from the medicine cartridge 370 through the tip 112 and into the mouth 102 of the infant 101.

In some embodiments, the process 1000 can include viewing, at a status indicator along the housing of the device, a value indicative of a cumulative dosage amount dispensed from the medicine cartridge. For example the dosage indicator 210 (FIG. 1) and 732 (FIG. 7) can display numbers, letters, and/or symbols that can show the user how many doses have been dispensed from the medicine cartridge 370.

Alternatively, the process 1000 can include viewing, at a status indicator along the housing of the device, a value indicative of a cumulative dosage amount remaining within the medicine cartridge. For example the dosage indicator 210 and 732 can display numbers, letters, and/or symbols that can show the user how many doses remain in the medicine cartridge 370.

In some embodiments, the process 1000 can include applying the distal end of the flexibly compliant oral applicator tip to the mouth of a human infant, and the distal end can be configured for the oral application of the selected dosage amount to a human infant. The process 1000 can also include applying, through the flexibly compliant oral applicator tip and to the mouth of the human infant, the selected dosage amount. For example, the tip 112 of the device 100 or 700 can be inserted into the mouth 102 of the infant 101, and the user can actuate the dose activator input 130 or 730 to initiate dispensing of the selected dosage from the medicine cartridge 370 through the tip 112 and into the mouth 102 of the infant 101.

Although a number of different implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. An oral dosing device comprising:

a housing having a proximal end, a distal end, and an interior space defined between a first end and a second end;

a medicine cartridge disposed within the housing and having a movable plunger at least partially disposed within the medicine cartridge;

a flexibly compliant oral applicator tip positioned at the distal end and shaped to slidably engage an inner surface of a mouth, wherein a fluid conduit defined in the distal end extends from the medicine cartridge to a distal port of the flexibly compliant oral applicator tip, wherein the flexibly compliant oral applicator tip is flexibly compliant along its entire distal length extending to the distal port, the distal end of the flexibly compliant oral applicator tip is configured and sized according to a cheek of a human infant, and the compliant oral applicator tip is configured to orally dispense the selected dosage amount to the human infant;

a dosage selector device positioned along the housing, the dosage selector device being configured to receive a manual user selection and configured to display a value indicative of a selected dosage amount;

a dose activator positioned along the housing and being different from the dosage selector device, wherein in response to user actuation of the dose activator relative to the housing, the moveable plunger is displaced by a distance based on the selected dosage amount displayed by the dosage selector.

2. A method of using an oral dosing device, comprising:

inserting a flexibly compliant oral applicator tip of a handheld oral dosing device into a mouth of an infant while grasping the handheld oral dosing device with a single hand, wherein the flexibly compliant oral applicator tip is flexibly compliant along its entire distal length extending to a distal port;

manually adjusting with the single hand a dosage selector of the handheld oral dosing device to select a dosage amount from a plurality of predefined dosage amounts of a narcotic fluid to be dispensed from a medicine cartridge mounted in a housing of the handheld oral dosing device, wherein the selected dosage amount is displayed by the oral dosing device; and after manually adjusting the dosage selector with the single hand to select the dosage amount from the plurality of predefined dosage amounts, actuating with the single hand a dose activator positioned along the housing of the handheld oral dosing device while the flexibly compliant oral applicator tip of the handheld oral dosing device is positioned in the mouth of the infant so that the selected dosage amount of the narcotic fluid is dispensed from the medicine cartridge, through a fluid conduit extending from the medicine cartridge to the distal port of the flexibly compliant oral applicator tip of the handheld oral dosing device, and into the mouth of the infant.

3. The method of claim 2, further comprising viewing, at a status indicator positioned along a housing of the oral dosing device, a value indicative of a cumulative dosage amount dispensed from the medicine cartridge.

4. The method of claim 2, further comprising viewing, at a status indicator positioned along a housing of the oral dosing device, a value indicative of a cumulative dosage amount remaining within the medicine cartridge.

5. The method of claim 2, wherein the selecting of the selected dosage amount is selected in increments of 0.01 milliliters.

6. The method of claim 2, wherein said inserting comprises applying a distal end of the flexibly compliant oral applicator tip to an interior cheek surface of the human infant, wherein the distal end is configured for the oral application of the selected dosage amount to the human infant.

7. An oral dosing device comprising:

a housing having a proximal end, a distal end, and an interior space defined between a first end and a second end;

a medicine cartridge disposed within the housing and having a movable plunger at least partially disposed within the medicine cartridge;

a flexibly compliant oral applicator tip positioned at the distal end and shaped to slidably engage an inner surface of a mouth, wherein a fluid conduit defined in the distal end extends from the medicine cartridge to a distal port of the flexibly compliant oral applicator tip;

a dosage selector device positioned along the housing, the dosage selector device being configured to receive a manual user selection and configured to display a value indicative of a selected dosage amount;

a dose activator positioned along the housing and being different from the dosage selector device, wherein in response to user actuation of the dose activator relative to the housing, the moveable plunger is displaced by a distance based on the selected dosage amount displayed by the dosage selector, wherein the dose activator is connected with an activator arm that is spring-biased to trigger movement of the movable plunger in response to user actuation of the dose activator, and the activator arm is selectively coupled to the dose selector via a movable link that mechanically mates with the activator arm at different positions from a plurality of mating positions dependent upon the dosage selector device receiving the user selection of the selected dosage amount from the plurality of predefined dosage amounts.

8. A method of controlling an oral dosing device, comprising:

receiving user input at a dosage selector of a handheld oral dosing device, the user input being indicative of a selected dosage amount to be dispensed from a medicine cartridge mounted in a housing of the handheld oral dosing device, wherein the selected dosage amount is displayed by the oral dosing device in response to the user input;

in response to user actuation of a dose activator positioned along the housing of the handheld oral dosing device, driving a moveable plunger forwardly within the medicine cartridge housed within the handheld oral dosing device by a longitudinal distance defined by the user input indicative of the selected dosage amount, wherein said driving the moveable plunger forwardly within the medicine cartridge comprises triggering movement of an activator arm that is connected to the dose activator and that is spring-biased to urge the movable plunger forward, wherein the activator arm is selectively coupled to the dose selector via a movable link that mechanically mates with the activator arm at different positions from a plurality of mating positions dependent upon the user input at the dosage selector device of the selected dosage amount from a plurality of predefined dosage amounts; and causing the selected dosage amount of medicinal fluid to dispense from the medicine cartridge, through a fluid conduit extending from the medicine cartridge to a distal port of a flexibly compliant oral applicator tip of the handheld oral dosing device, and into a mouth adjacent to the flexibly compliant oral applicator tip.

* * * * *